US006299023B1

(12) United States Patent
Arnone

(10) Patent No.: US 6,299,023 B1
(45) Date of Patent: Oct. 9, 2001

(54) DEVICE FOR DISPENSING TWO SUBSTANCES IN A USER SELECTABLE RATIO WITH REPLACEABLE CARTRIDGES

(76) Inventor: Miles Arnone, 270 W. Main St., Hopkinton, MA (US) 01748

( * ) Notice: Subject to any disclaimer, the term of this patent is extended or adjusted under 35 U.S.C. 154(b) by 0 days.

(21) Appl. No.: 09/645,197

(22) Filed: Aug. 24, 2000

(51) Int. Cl.[7] ..... B65D 35/22; B65D 35/56; B67D 5/00; B67D 5/52; B67D 1/16; B67D 5/40; B67D 5/06

(52) U.S. Cl. ..... 222/94; 222/105; 222/137; 222/109; 222/318; 222/144.5; 222/325; 222/82

(58) Field of Search ..... 222/94, 105, 129, 222/142.3, 145.7, 137, 106, 107, 209, 109, 110, 318, 424, 144.5, 325, 82

(56) References Cited

U.S. PATENT DOCUMENTS

| | | | | |
|---|---|---|---|---|
| 3,580,429 | * | 5/1971 | Trindle | 222/327 |
| 4,826,048 | * | 5/1989 | Skorka et al. | 222/137 |
| 5,337,921 | * | 8/1994 | Wilson et al. | 222/105 |
| 5,356,040 | * | 10/1994 | Reggiani | 222/129 |
| 5,385,270 | | 1/1995 | Cataneo et al. | 222/134 |
| 5,411,176 | * | 5/1995 | Favre | 222/94 |
| 5,560,545 | | 10/1996 | Grogan et al. | 222/304 |
| 5,568,883 | | 10/1996 | Cataneo et al. | 222/136 |
| 5,634,571 | | 6/1997 | Cataneo et al. | 222/80 |
| 5,752,626 | | 5/1998 | Bachand | 222/136 |
| 5,848,732 | | 12/1998 | Brugger | 222/137 |
| 5,887,761 | | 3/1999 | Foster et al. | 239/304 |
| 5,947,335 | | 9/1999 | Milio et al. | 222/136 |
| 5,967,372 | | 10/1999 | Favre | 222/137 |
| 5,971,210 | | 10/1999 | Brugger | 222/137 |

* cited by examiner

*Primary Examiner*—Kevin Shaver
*Assistant Examiner*—Stephanie Willatt
(74) *Attorney, Agent, or Firm*—Kriegsman & Kriegsman

(57) ABSTRACT

A device for dispensing a base substance and a booster substance in a user selectable ratio includes a dispenser head having a pair of spaced apart outlet ports, a first cartridge containing the base substance which is removably coupled onto the dispenser head and a second cartridge containing the booster substance which is removably coupled onto the dispenser head. Each of the first and second cartridges include a collapsible plastic liner which is mounted onto a supporting frame, the supporting frame of each cartridge having a uniquely shaped flange. A first pump assembly is disposed within the dispenser head and serves to draw a fixed amount of the base substance from the first cartridge and dispense the fixed amount of base substance out one of the outlet ports upon depression of a trigger which is slidably disposed in the dispenser head. A second pump assembly is disposed within the dispenser head and serves to draw a fixed amount of the booster substance from the first cartridge upon depression of the trigger, dispense a user selectable percentage of the fixed amount of booster substance out the other outlet port and return the remaining percentage of the fixed amount of the booster substance back into the second cartridge.

36 Claims, 8 Drawing Sheets

DEVICE FOR DISPENSING TWO SUBSTANCES IN A USER SELECTABLE RATIO WITH REPLACEABLE CARTRIDGES

BACKGROUND OF THE INVENTION

The present invention relates generally to dispensers and more particularly to devices for co-dispensing two or more substances which mixed together form an amalgamated product.

Devices for dispensing substances, or dispensers, are well known and widely used in the art.

Devices adapted to co-dispense two or more substances which mix together to form an amalgamated product are well known in the art. Such devices are widely used in numerous commercial applications, such as in the dispensing of cosmetic, food or drink products. Devices adapted to co-dispense two or more substances are typically constructed to dispense the amalgamated product in a single, fixed, ratio between the two or more constituent substances. However, it has found to be desirable in certain applications to vary the ratio of the constituent substances which make up the amalgamated composition.

Accordingly, devices having multiple chambers for holding different flowable substances which allow for the selectable adjustment of the relative concentration of the substances dispensed thereby have been conceived in several different forms.

As an example, in U.S. Pat. No. 5,568,883 to R. J. Cataneo et al., there is disclosed an apparatus for dispensing two flowable substances in a user-selectable ratio. The dispensing apparatus includes first and second containers for receiving flowable substances. Each container has a dispensing end and a second end which initially includes a piston, which is movable only toward the dispensing end as the substances are dispensed. The dispensing apparatus also includes a manifold member having an inlet with a pair of inlet openings for removably receiving the containers. The manifold member is internally divided into two chambers for receiving the respective flowable substances. A pump member, which is movable with respect to the manifold chamber, having an inlet end in fluid communication with the manifold chambers is provided. A selector member with a single opening is provided in fluid communication with the outlet end of the manifold member. Upon movement of the pump member by a user in a first direction from its initial position with respect to the manifold member, a predetermined measure of flowable substance is dispensed from the apparatus. The ratio of the dispensed substances is user variable from 100% of the first flowable substance and 0% of the second flowable substance when the selector member is in the first position, to 0% of the first flowable substance and 100% of the second flowable substance when the selector member is in the second position, to any desired ratio therebetween when the selector member is in an intermediate position.

As another example, in U.S. Pat. No. 5,947,335 to R. J. Milio et al., there is disclosed a dispenser having at least two compartments wherein the amount of product dispensed from at least one of the compartments can be adjusted prior to dispensing. Advantageously, products in both compartments are dispensed using the same actuator. Different volumes of product can be dispensed from at least one of the chambers even though the volume of product dispensed from the other chamber need not be varied and even though the same actuator may be used to effect the dispensing of product.

It has been found that conventional devices for co-dispensing two or more substances in a user adjustable ratio typically suffer from one or more notable design flaws that impair or detract from the functionality of the product to accurately dispense the desired quantities of the constituent substances which form the amalgamated product.

As an example, it has been found that certain prior art devices which co-dispense two or more substances in a user adjustable ratio often inaccurately dispense the desired quantities of the constituent substances which form the amalgamated product due to inconsistencies in energy transmission. Specifically, conventional devices for co-dispensing two or more substances which utilize a multi-chamber squeeze-type bottle require the user to apply a constant and equal amount of pressure to each chamber of the dispenser throughout the application of pressure in order to ensure the proper consistency of the amalgamated product. As can be appreciated, if the user applies an inconsistent amount of pressure on the device, the relative quantities of the constituent substances delivered will vary, thereby producing an amalgamated product having an inaccurate proportion of its constituent substances.

As another example, it has been found that certain prior art devices which co-dispense two or more substances in a user adjustable ratio often inaccurately dispense the desired quantities of the constituent substances which form the amalgamated product due to dissimilarities in the viscosities of the constituent substances. Specifically, conventional devices for co-dispensing two or more substances which utilize a single pump mechanism to draw multiple constituent substances of dissimilar viscosities will preferentially draw more of the lower viscosity substance than the higher viscosity substance, thereby producing an amalgamated product having an inaccurate proportion of its constituent substances.

As another example, it has been found that certain prior art devices which co-dispense two or more substances in a user adjustable ratio often inaccurately dispense the desired quantities of the constituent substances which form the amalgamated product due to individual variances in the viscosity of each constituent substance. Specifically, conventional devices for co-dispensing two or more substances in a user adjustable ratio will often experience changes in the viscosity of each constituent substance over time due to changes in environmental conditions, such as temperature, pressure or humidity. As a consequence, the change in the viscosity of each constituent substance will cause the device to preferentially draw more of the lower viscosity substance than the higher viscosity substance, thereby producing an amalgamated product having an inaccurate proportion of its constituent substance. It should be noted that problems associated with the changes in the viscosity of each constituent substance is particularly relevant when dispensing suntan lotion because the amalgamated product is often dispensed while exposed to a relatively cool environment (i.e., within an air conditioned building having a temperature of 68° Fahrenheit) and a relatively hot environment (i.e., on a beach having a temperature reaching 100° Fahrenheit), thereby exposing the product to a significantly large range of operating temperatures.

As another example, it has been found that certain prior art devices which co-dispense two or more substances in a user adjustable ratio often inaccurately dispense the desired quantities of the constituent substances which form the amalgamated product due to system lag in the dispenser. Specifically, conventional devices for co-dispensing two or more substances in a user adjustable ratio are often constructed to include a baffling chamber located between the metering assembly and the dispenser outlet, the baffling chamber serving as a compartment in which the multiple solutions mix to form the desired amalgamated product. In use, remnants of the mixed product often lag within the baffling chamber and can compromise the accuracy of the relative quantities of the constituent substances in future mixtures. As a result, in order to accurately dispense a mixed product in a user-selectable ratio, the lagging contents must be completely emptied from the baffling chamber before forming the amalgamated product in its intended ratio.

As another example, it has been found that certain prior art devices which co-dispense two or more substances in a user adjustable ratio often inaccurately dispense the desired quantities of the constituent substances which form the amalgamated product due to variable back pressure in the dispenser. Specifically, conventional devices for co-dispensing two or more substances which include a selector dial for adjusting the ratio of the constituent flowable substances which are mixed within a baffling chamber will often experience a resistance to flow , or back pressure, exerted by the mixture in the chamber which will vary depending upon the setting of the selector dial and the composition of the resulting mixture in the chamber. As a result, the composition of the amalgamated mixture, which is created by mechanisms that depend upon a known resistance to flow downstream of a pump mechanism will vary as a function of the mixture from the previous dispensing cycle, thereby creating a mixture of substances in an inaccurate ratio.

In addition to the design flaws noted above that impair the ability of a dispenser to accurately dispense the desired quantities of the constituent substances which form the amalgamated product, certain prior art devices which co-dispense two or more substances in a user adjustable ratio suffer from additional drawbacks.

As an example, it has been found that certain prior art devices which co-dispense two or more substances in a user adjustable ratio are mechanically complicated in nature. Specifically, conventional devices for co-dispensing two or more substances in a user adjustable ratio often utilize an internal diaphragm to create multiple internal chambers for the substances, thereby creating a relatively complex device which requires a considerable number of parts. Due to its considerable complexity, such a device is relatively difficult and costly to manufacture.

As another example, it has been found that certain prior art devices which co-dispense two or more substances in a user adjustable ratio are often difficult to use. Specifically, conventional devices for co-dispensing two or more substances in a user adjustable ratio are not typically designed to be operated with one hand. To the contrary, conventional devices for co-dispensing two or more substances in a user adjustable ratio often require that the dispenser be placed on a table or other firm horizontal surface to counteract the forces needed to actuate the dispenser. In this manner, one hand is typically used to actuate the dispenser and the other hand is used to receive the amalgamated mixture. As a result, because the user is precluded from holding the dispenser in one hand and ejecting the amalgamated mixture into the other, the device can not be used in those situations in which the consumer does not have access to a firm support surface, such as while dispensing suntan lotion on the beach.

SUMMARY OF THE INVENTION

It is an object of the present invention to provide a new and improved device for dispensing two substances.

It is another object of the present invention to provide a device as described above which dispenses the two substances in a user selectable ratio.

It is yet another object of the present invention to provide a device as described above which accurately dispenses the two substances in the user selectable ratio.

It is still another object of the present invention to provide a device as described above which is adapted to eliminate problems associated with inconsistencies in energy transmission.

It is another object of the present invention to provide a device as described above which is adapted to eliminate problems associated with dissimilarities in the viscosities of the two substances.

It is yet another object of the present invention to provide a device as described above which is adapted to eliminate problems associated with the individual variances in the viscosity of each substance.

It is still another object of the present invention to provide a device as described above which is adapted to eliminate problems associated with system lag in the device.

It is yet still another object of the present invention to provide a device as described above which is adapted to eliminate problems associated with variable back pressure in the device.

It is another object of the present invention to provide an apparatus as described above which requires a limited number of parts, which is easy to use and which is inexpensive to manufacture.

Accordingly, there is provided a device for dispensing a base substance and a booster substance in a user selectable ratio, said device comprising a dispenser head, a first cartridge coupled to said dispenser head, said first cartridge containing the base substance, a second cartridge coupled to said dispenser head, said second cartridge containing the booster substance, a first pump assembly disposed within said dispenser head, said first pump assembly comprising an inlet tube for drawing a fixed amount of the base substance from said first cartridge and an discharge tube for dispensing the fixed amount of the base substance out said dispenser head, and a second pump assembly disposed within said dispenser head, said second pump assembly comprising an inlet tube for drawing a fixed amount of the booster substance from said second cartridge, a discharge tube for dispensing a user selectable percentage of the fixed amount of the booster substance out said dispenser head and a return tube for rerouting the remaining percentage of the fixed amount of the booster substance back into said second cartridge.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration a particular embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims. dr

BRIEF DESCRIPTION OF THE DRAWINGS

The accompanying drawings, which are hereby incorporated into and constitute a part of this specification, illustrate a particular embodiment of the invention and, together with the description, serve to explain the principles of the invention. In the drawings wherein like reference numerals represent like parts.

DETAILED DESCRIPTION OF A PREFERRED EMBODIMENT.

Figure 1:
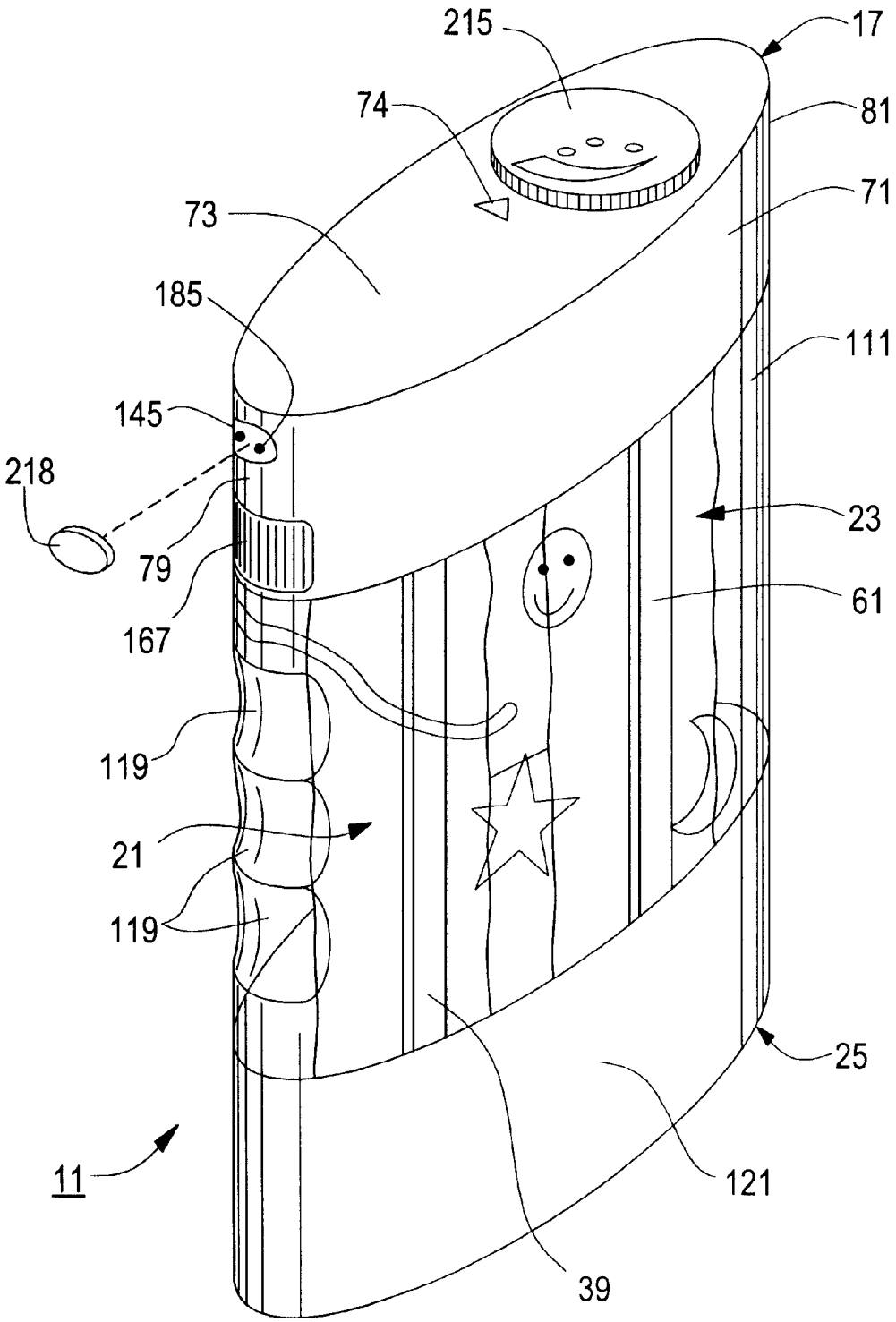
FIG. 1 is a top perspective view of a device constructed according to the teachings of the present invention for dispensing two substances in a user selectable ratio.
Figure 2:
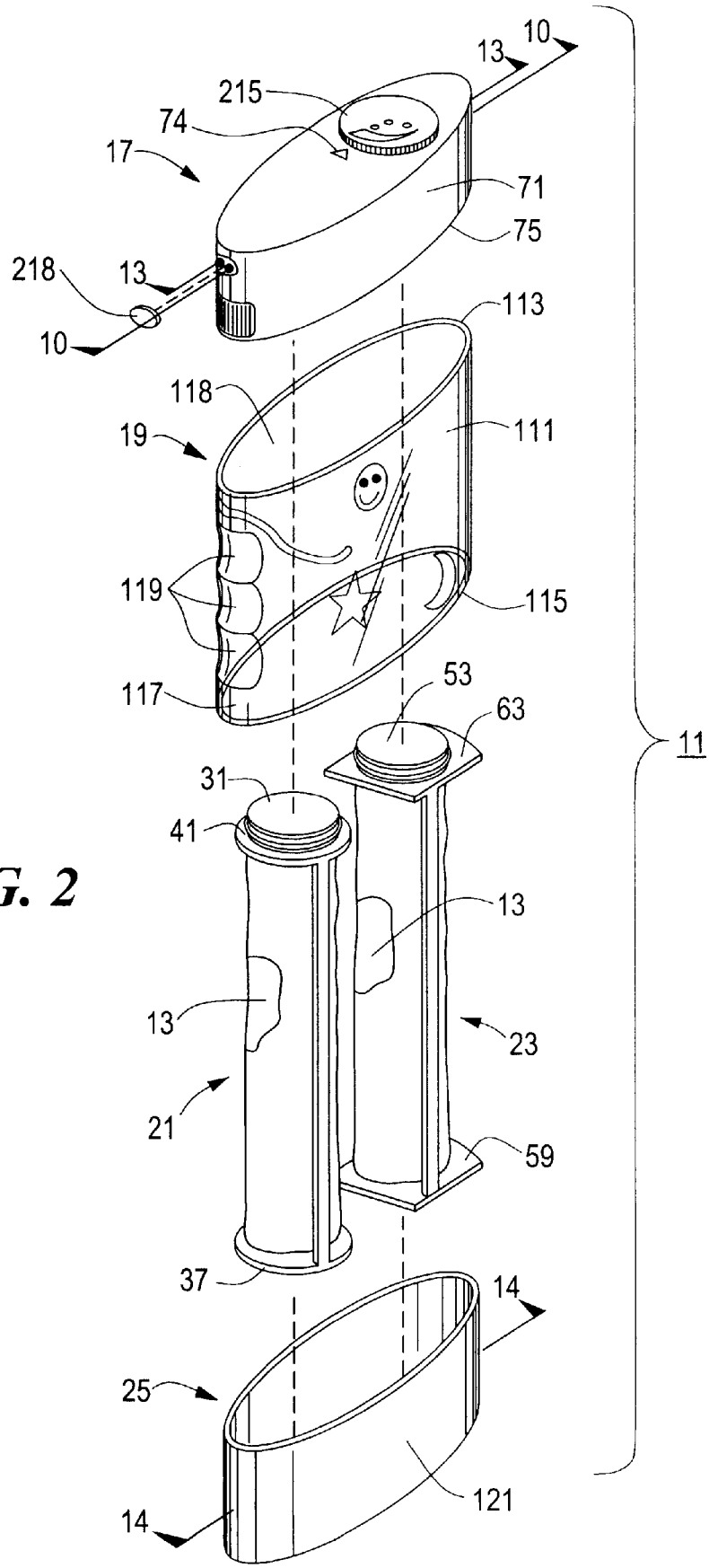
FIG. 2 is an exploded, top perspective view of the device shown in FIG. 1.

Referring now to FIG. 1, there is shown a device constructed according to the teachings of the present invention for co-dispensing two substances, the device being identified by reference numeral 11. As will be described further in detail below, device 11 can be used to co-dispense a base, or primary, substance 13 and a booster, or secondary, substance 15 in a user selectable ratio.

Device 11 comprises a dispenser head 17, a dispenser body 19, a first replaceable cartridge 21 which contains base substance 13, a second replaceable cartridge 23 which contains booster substance 15 and a dispenser bottom cap 25.

Figure 4:
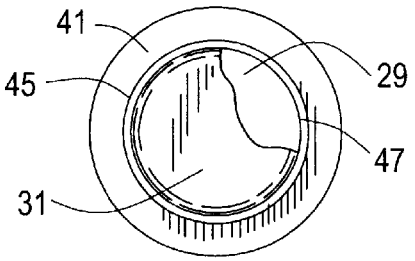
FIG. 4 is a top plan view, broken away in part, of the first cartridge shown in FIG. 3.
Figure 3:
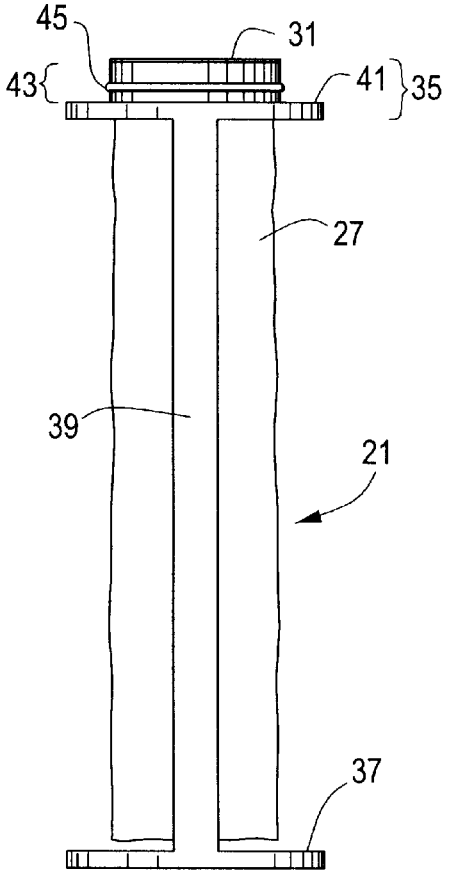
FIG. 3 is a side view of the first cartridge shown in FIG. 2.
Figure 5:
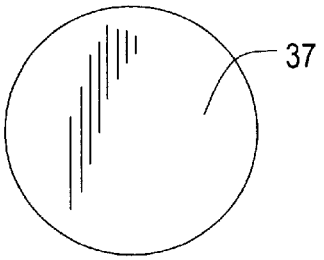
FIG. 5 is a bottom plan view of the first cartridge shown in FIG. 3.

Referring now to FIGS. 3–5, first replaceable cartridge 21 comprises a liner 27 in which a supply of base substance 13 is contained. Liner 27 is preferably constructed of a collapsible plastic material which is clear or opaque to enable the user to visibly determine the amount of base substance 13 contained therein. Liner 27 is shaped to include a generally circular, open top end 29 which provides access to the base substance 13 held therein. A foil seal 31 is disposed over open top end 29 and is secured to liner 27 by an adhesive (not shown) to enclose top end 29 and thereby prevent any unintentional spillage of base substance 13 from liner 27.

Liner 27 is removably mounted on a supporting frame 33 which provides structural support for cartridge 21. Supporting frame 33 is constructed of a rigid and durable material, such as plastic, and comprises a head 35, a foot 37 and a pair of rigid, side support members, or pillars, 39 which connect head 35 to foot 37. Preferably, supporting frame 33 is molded as an integral piece. However, it is to be understood that supporting frame 33 could be alternatively formed from multiple pieces without departing from the spirit of the present invention.

Head 35 is generally cylindrical and is shaped to include an outwardly projecting flange 41 and a neck 43. Outwardly projecting flange 41 is generally disc-shaped, as shown in FIG. 4. As will be described further in detail below, flange 41 is uniquely configured to mate with a similarly shaped recess which is formed in dispenser head 17. As can be appreciated, the unique configuration of flange 41 serves two principal purposes. First, the unique configuration of flange 41 ensures that cartridges 21 and 23 are not inadvertently switched when installed into dispenser head 17. Second, the unique configuration of flange 41 serves to guide cartridge 21 into position within dispenser head 17 during installation.

It should be noted that flange 41 is not limited to a disc-shaped construction. Rather, flange 41 could be constructed in any unique configuration (i.e, rectangular, oval or diamond) which will prevent the inadvertent switching of cartridges 21 and 23 during the installation process without departing from the spirit of the present invention.

Neck 43 is disposed above flange 41 and is shaped to include an outwardly projecting snap-in ring 45 and an open top end 47. Outwardly projecting snap-in ring 45 is generally disc-shaped, as shown in FIG. 4, and is sized to be snap fit into an associated retention ring recess which is formed into dispenser head 17, as will be described further in detail below. As can be appreciated, snap-in ring 45 serves two principal purposes. First, snap-in ring 45 ensures that cartridge 21 is securely connected to dispenser head 17. Second, snap-in ring 45 creates a tight seal between cartridge 21 and dispenser head 17 so as to prevent any leakage of base substance 13 from dispenser head 17.

Open top end 47 of supporting frame 33 is generally circular in shape and is sized to enable liner 27 to be fittingly disposed within frame 33. Preferably, open top end 29 of liner 27 and foil seal 31 lie substantially flush with open top end 47 of supporting frame 33.

Foot 37 is generally circular in shape, as shown in FIG. 5, so as to notify the user of the general shape of the flange 41, thereby identifying cartridge 21 to prevent inadvertent switching. The enlarged, flat shape of foot 37 also serves as a useful gripping surface during the installation and/or removal of cartridge 21 from device 11. Although foot 37 is shown as being circular in shape, it is to be understood that foot 37 could be constructed in any alternative shape in which flange 41 is constructed without departing from the spirit of the present invention.

Side support members 39 are elongated structures which are integrally formed at one end to head 35 and at the other end to foot 37. Preferably, side support members 39 are spaced equally apart around liner 27, approximately 180 degrees, to maximize the structural integrity of frame 33. Although frame 33 is shown comprising two support members 39, it is to be understood that frame 33 could include alternative numbers of support members 39 without departing from the spirit of the present invention.

Liner 27 is preferably attached to the inner surface of head 35 by an adhesive (not shown), thereby enabling supporting frame 33 to be reused with replacement liners 27 as necessary. However, it is to be understood that liner 27 is not limited to being removably mounted onto supporting frame 33. Rather, liner 27 could alternatively be permanently attached to frame 33 without departing from the spirit of the present invention. For example, without having foil seal 31 mounted on liner 27, open top end 29 of liner 27 could be folded over open top end 47 of supporting frame 33. With liner 27 disposed as such, the application of foil seal 31 over open end 29 of liner 27 and onto head 35 would serve to permanently pin down liner 27 onto supporting frame 33.

Figure 7:
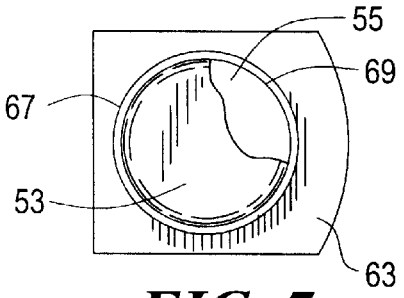
FIG. 7 is top plan view, broken away in part, of the second cartridge shown in FIG. 6.
Figure 6:
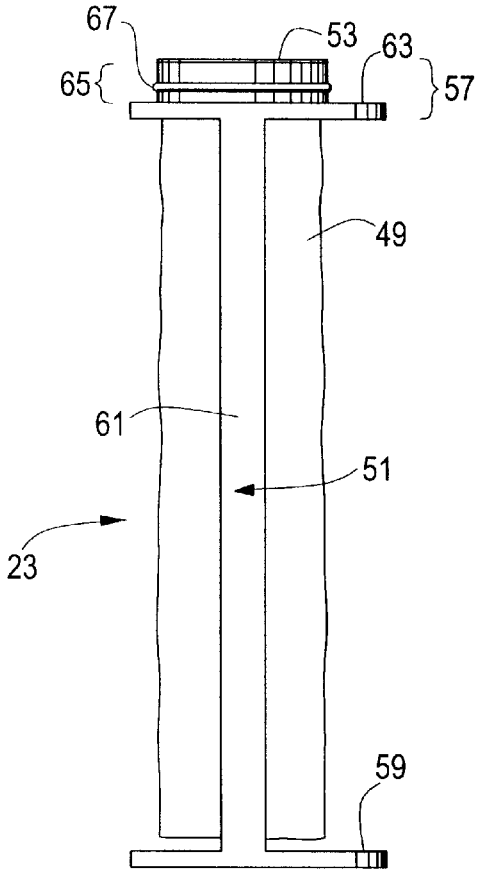
FIG. 6 is a side plan view of the second cartridge shown in FIG. 2.
Figure 8:
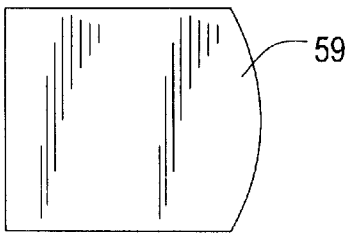
FIG. 8 is a bottom plan view of the second cartridge shown in FIG. 6.

Referring now to FIGS. 6–8, second replaceable cartridge 23 is similar in construction to first replaceable cartridge 21 in that second replaceable cartridge 23 comprises a liner 49 and a supporting frame 51 on which liner 49 is mounted.

Liner 49 is identical in construction with liner 27 and contains a supply of booster substance 15 therewithin. A foil seal 53 identical in construction with foil seal 31 is disposed over open top end 55 of liner 49 to prevent booster substance 15 from unintentionally spilling out from liner 49.

Supporting frame 51 is similar in construction with supporting frame 33 in that supporting frame 51 comprises a head 57, a foot 59 and a pair of rigid side support members 61 which connect head 57 to foot 59, support members 61 being identical in construction to support members 39.

Head 57 is similar to head 35 in that head 57 comprises an outwardly projecting flange 63 and a neck 65 which is shaped to include a snap-in ring 67 and an open top end 69. Head 57 is identical to head 35 in all respects except for the fact that outwardly projecting flange 63 has a different shape than outwardly projecting flange 41. Specifically, flange 63 has a unique, generally D-shaped configuration, as shown in FIG. 7, which is sized to fittingly mate with a similarly shaped recess formed in dispenser head 17. As can be appreciated, the considerable difference in shapes between flanges 63 and 41 serves to prevent cartridges 21 and 23 from being accidently switched during the installation process, which is highly desirable.

Foot 59 differs from foot 37 only in that foot 59 has a D-shaped configuration, as shown in FIG. 8. The unique shape of foot 59 serves to easily identify the shape of flange 63 and, accordingly, the contents contained within cartridge 23.

It should be noted that flange 63 and foot 59 are not limited to having a D-shaped configuration. Rather, flange 63 and foot 59 could be alternatively constructed in any shape other than the shape flange 41 and foot 37 so as to prevent cartridges 21 and 23 from being accidently switched during the installation process without departing from the spirit of the present invention.

Cartridges 21 and 23 are adapted to be removably installed in device 11. Accordingly, if the supply of base substance 13 and/or booster substance 15 becomes depleted, cartridges 21 and 23 are adapted to be readily replaced, thereby rendering device 11 reusable, which is environmentally and economically desirable. It should be noted that, since cartridges 21 and 23 are replaceable, device 11 need not initially have an equal supply of base substance 13 and booster substance 15. Furthermore, although device 11 preferably comprises replaceable cartridges 21 and 23, it is to be understood that device 11 could be alternatively constructed to include cartridges which remain permanently installed within device 11 without departing from the spirit of the present invention.

Dispenser head 17 comprises a continuous sidewall 71, a generally flat top surface 73 and a bottom surface 75 which are integrally formed together, such as through molding, to make dispenser head 17 an integral piece. Sidewall 71, top surface 73 and bottom surface 75 together define a dispenser head interior chamber 77 therebetween which is generally oval in lateral cross-section and rectangular in longitudinal cross-section. Sidewall 71 is shaped to include a front end 79 and a rear end 81.

Figure 9:
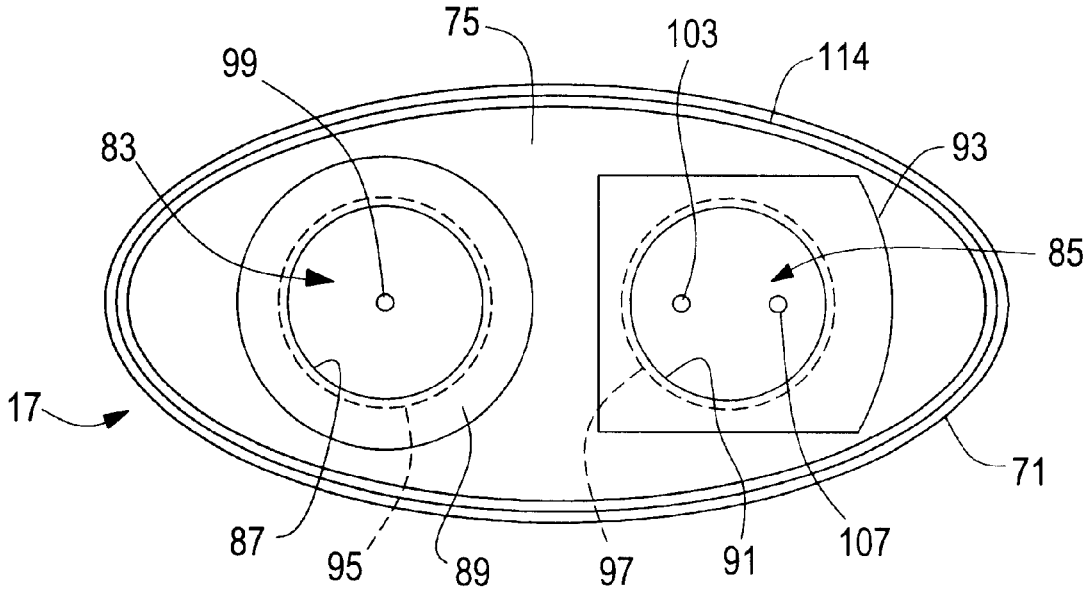
FIG. 9 is a bottom plan view of the dispenser head shown in FIG. 2.
Figure 10:
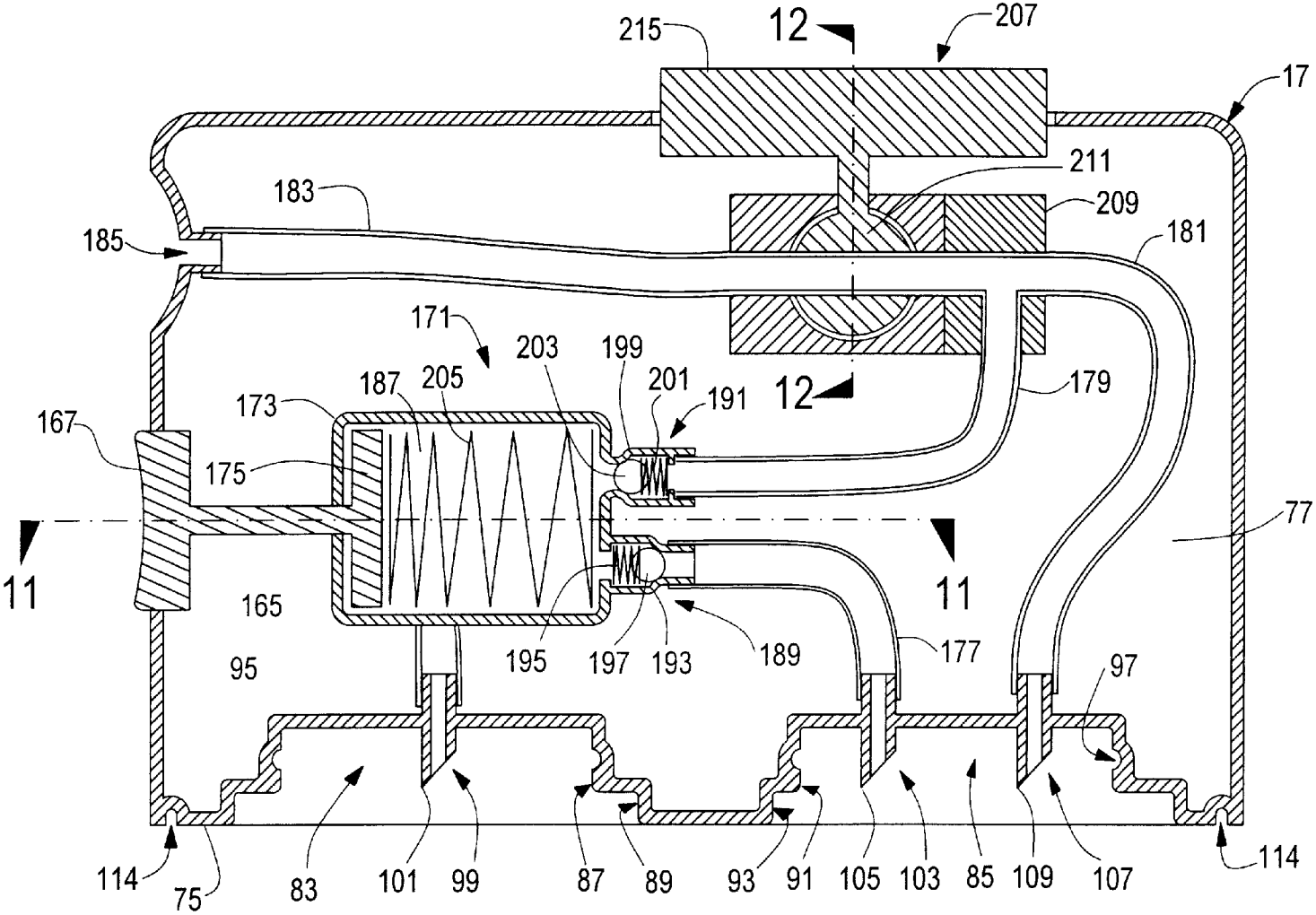
FIG. 10 is a side, section view of the dispenser head shown in FIG. 2, taken along lines 10—10.
Figure 13:
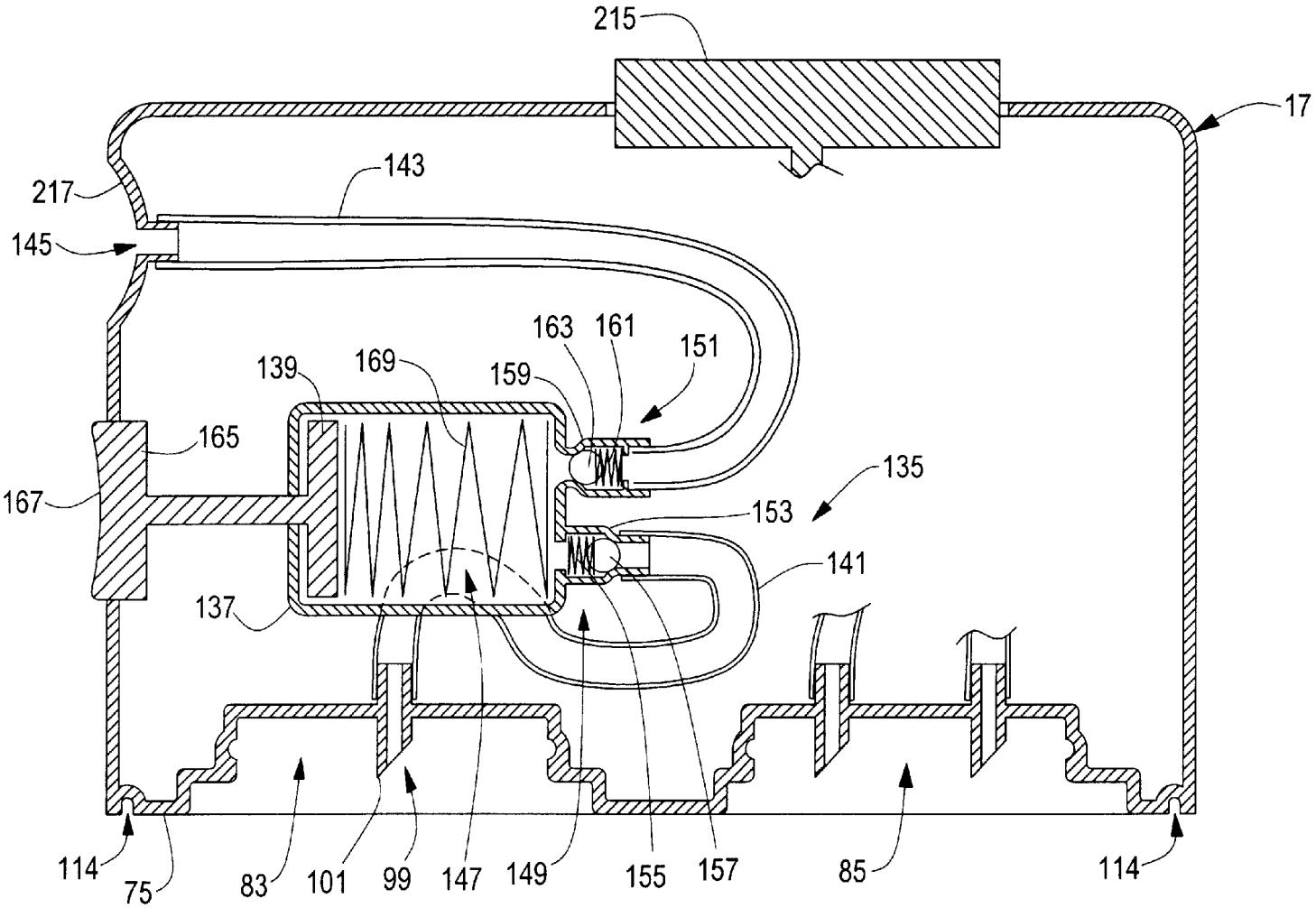
FIG. 13 is a side, section view of the dispenser head shown in FIG. 2, taken along lines 13—13.

Referring now to FIGS. 9, 10 and 13, bottom surface 75 of dispenser head 17 is shaped to include a first cartridge receiving recess 83 which is sized and shaped to receive head 35 of first replaceable cartridge 21 and a second cartridge receiving recess 85 which is shaped to receive head 57 of second replaceable cartridge 23. Preferably, recesses 83 and 85 are integrally formed into bottom surface 75 of head 17 using conventional molding techniques.

First cartridge receiving recess 83 includes a neck receiving portion 87 which is sized and shaped to fittingly receive neck 43 of first replaceable cartridge 21 and a flange receiving portion 89 which is sized and shaped to fittingly receive flange 41 of first replaceable cartridge 21. It should be noted that flange receiving portion 89 is generally circular in configuration so as to matingly receive outwardly projecting flange 41 of first replaceable cartridge 21. As can be appreciated, the unique configuration of flange receiving portion 89 ensures that only first replaceable cartridge 21, and not second replaceable cartridge 23, is capable of being installed in recess 83, which is highly desirable.

Similarly, second cartridge receiving recess 85 includes a neck receiving portion 91 which is sized and shaped to fittingly receive neck 65 of second replaceable cartridge 23 and a flange receiving portion 93 which is sized and shaped to fittingly receive flange 63 of second replaceable cartridge 23. It should be noted that flange receiving portion 93 is generally D-shaped in configuration and is adapted to fittingly receive outwardly projecting flange 63 of second replaceable cartridge 23. As can be appreciated, the unique configuration of flange receiving portion 93 ensures that only second replaceable cartridge 23, and not first replaceable cartridge 21, is capable of being installed in recess 85, which is highly desirable.

Bottom surface 75 is also shaped to include a first retention ring recess 95 and a second retention ring recess 97 which are preferably integrally formed into bottom surface 75 of head 17 using conventional molding techniques. First retention ring recess 95 is generally ring-shaped and is sized and shaped to receive snap-in ring 45 of cartridge 21 to ensure the secure connection of cartridge 21 to dispenser head 17 and to prevent base substance 13 from leaking out of dispenser head 17. Similarly, second retention ring recess 97 is generally ring-shaped and is sized and shaped to receive snap-in ring 67 of cartridge 23 to ensure the secure connection of cartridge 23 to dispenser head 17 and to prevent booster substance 15 from leaking out of dispenser head 17. As can be appreciated, with snap-in rings 45 and 67 matingly engaged within recesses 95 and 97, respectively, first and second cartridges 21 and 23 can be removed from dispenser head 17 only upon the application of a significant downward withdrawal force.

A suction dip tube 99 having a sharpened tip 101 is integrally formed into dispenser head 17 and disposed to extend from interior chamber 77, through bottom surface 75 and down into first cartridge receiving recess 83. Similarly, a suction dip tube 103 having a sharpened tip 105 and a return dip tube 107 having a sharpened tip 109 are integrally formed into dispenser head 17 and are disposed to extend from interior chamber 77, through bottom surface 75 and down into second cartridge receiving recess 85.

Sharpened tip 101, which is preferably constructed of a rigid plastic, is angled so as to easily pierce through foil seal 31 and project down into liner 27 upon installation of cartridge 21 into dispenser head 17. Similarly, sharpened tips 105 and 109, which are preferably constructed of a rigid plastic, are angled so as to easily pierce through foil seal 53 and project down into liner 49 upon installation of cartridge 23 into dispenser head 17. As such, suction dip tube 99 serves a conduit through which base substance 13 is drawn from cartridge 21 and passed into the dispenser head 17. Similarly, suction dip tube 103 serves as a conduit through which booster substance 15 is drawn from cartridge 23 and passed into dispenser head 17. Return dip tube 107 serves as a conduit through which excess booster substance 15, which is not dispensed by device 11, is returned from dispenser head 17 back into cartridge 23, as will be described further in detail below.

It should be noted that first flange receiving portion 89 is positioned beneath tip 101 of dip tube 99 so that foil seal 53 of cartridge 23 will not be inadvertently punctured if the user mistakingly attempts to insert second replaceable cartridge 23 into first cartridge receiving recess 83. Similarly, second flange receiving portion 93 is positioned beneath tips 105 and 109 so that foil seal 31 of cartridge 21 will not be inadvertently punctured if the user mistakingly attempts to insert first replaceable cartridge 21 into second cartridge receiving recess 85.

It should also be noted that, with cartridge 21 properly installed into dispenser head 17, suction dip tube 99 does not need to extend to the bottom of collapsible liner 27 in order to properly draw the supply of base substance 13 because, as substance 13 is drawn out of liner 27, the atmospheric pressure outside liner 27 causes it to collapse, thereby reducing its volume. As such, suction dip tube 99 is always in communication with base substance 13 contained within cartridge 21. Similarly, with cartridge 23 properly installed into dispenser head 17, suction dip tube 103 does not need to extend to the bottom of collapsible liner 49 in order to properly draw the supply of booster substance 15 because, as substance 15 is drawn out of liner 49, the atmospheric pressure outside liner 49 causes it to collapse, thereby reducing its volume. As such, suction dip tube 103 is always in communication with booster substance 15 contained within cartridge 23.

Dispenser body 19 comprises a continuous sidewall 111 which includes a substantially flat top edge 113, a substantially flat bottom edge 115 and a front 117. Sidewall 111 is shaped to define an interior cavity 118 therewithin which is generally oval in lateral cross-section.

Dispenser body 19 is adapted to be mounted onto dispenser head 17. Specifically, top edge 113 of body 19 is sized and shaped to fit snugly within an associated, oval-shaped, body retention groove 114 which is integrally formed into bottom surface 75 of dispenser head 17, as shown in FIGS. 10 and 13. Preferably, an adhesive (not shown) is disposed within retention groove 114 in order to permanently retain body 19 within dispenser head 17. It should be noted that groove 114 is formed into bottom surface 75 just inside the outer periphery of dispenser head 17 such that, with body 19 retained securely within groove 114, body 19 encloses and protects replaceable cartridges 21 and 23.

Dispenser body 19 is preferably constructed of a durable material, such as plastic, which can be formed using conventional molding techniques. In addition, at least a portion of body 19 is preferably constructed of a transparent or opaque material so as to enable the user to readily examine the supply of base substance 13 and booster substance 15 and determine whether replacement of cartridges 21 and 23, respectively, is necessary. Body 19 may be marked with designs that correlate to the target market for the device and/or product information, as desired. Front 117 of dispenser body 19 is preferably molded to include a plurality of finger-shaped indentations 119 which are ergonomically disposed to facilitate handling device 11. Although not shown, a plurality of friction pads may be mounted onto indentations 119 to prevent device 11 from slipping out from the hand of the user.

Dispenser bottom cap 25 is preferably constructed of a durable material, such as plastic, and comprises a continuous sidewall 121 and a bottom end 123 which are preferably integrally formed together, such as through molding, to make dispenser bottom cap 25 an integral piece. Sidewall 121 and bottom end 123 together define a dispenser bottom cap interior chamber 125 which is generally oval in lateral cross-section. Continuous sidewall 121 includes a top edge 127.

Bottom cap 25 is adapted to be removably mounted onto dispenser body 19. Specifically, bottom edge 115 of body 19 is sized and shaped to fit snugly within an associated, oval-shaped, body retention groove 129 which is integrally formed into top edge 127 of bottom cap 25. As such, body 19 is capable of being press fit and retained within bottom cap 25. In addition, body 19 is capable of being removed from bottom cap 25 upon the application of a significant separation force so as to provide access to cartridges 21 and 23.

Figure 14:
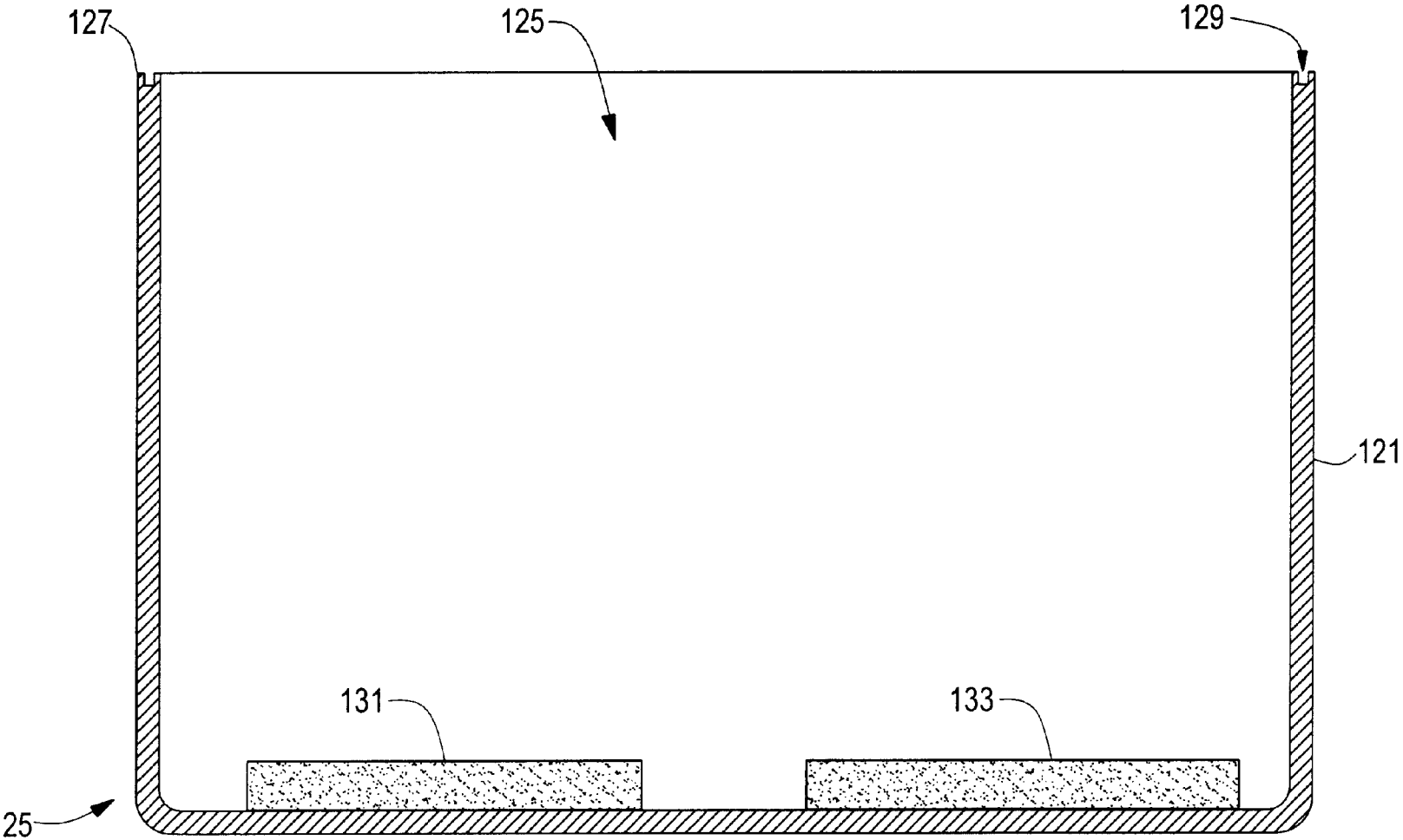
FIG. 14 is a side section view of the dispenser bottom cap shown in FIG. 2, taken along lines 14—14.

Bottom end 123 of bottom cap 25 includes a first foam pad 131 and a second foam pad 133 mounted thereon, as shown in FIG. 14. Foam pads 131 and 133 provide a slight preload support surface against feet 37 and 59, respectively, when device 11 is being installed. As such, foam pads 131 and 133 ensure a tight connection between first and second cartridges 21 and 23, respectively, and dispenser head 17.

Referring now to FIG. 13, device 11 also comprises a first pump mechanism 135 disposed within interior chamber 77 of dispenser head 17 which is adapted to retrieve and dispense a fixed amount of base substance 13 from cartridge 21 during use, as will be described further in detail below.

First pump mechanism 135 comprises a piston housing 137, a piston 139 slidably disposed within piston housing 137, an inlet tube 141 which provides fluid communication between suction dip tube 99 and piston housing 137 and a discharge tube 143 which provides fluid communication between piston housing 137 and an outlet port 145 which is formed in front end 79 of head 17.

Piston housing 137 is preferably, but not limited to, a generally rectangular enclosure which is shaped to include an interior cavity 147 therewithin. As can be appreciated, the volume of interior cavity 147 determines the amount of base substance 13 which is drawn from cartridge 21 during each actuation of piston 139. Piston housing 137 further comprises an inlet check valve assembly 149 in fluid communication with interior cavity 147 and an outlet check valve assembly 151 in fluid communication with interior cavity 147.

Inlet check valve assembly 149 comprises an inlet retention seat 153, an inlet check valve spring 155 and an inlet check valve ball 157. Spring 155 is disposed to resiliently urge ball 157 against retention seat 153. Ball 157 is sized and shaped relative to retention seat 153 so as to create a seal over retention seat 153 which is overcome only through activation of piston 139. Specifically, the vacuum created inside housing 137 as piston 139 retracts from actuation overcomes the force of spring 155, thereby allowing ball 157 to float off seat 153 to permit the passage of base substance 13 into interior cavity 147. As such, inlet check valve assembly 149 creates a one-way seal which allows for base substance 13 to be drawn into housing 137 but prevents base substance 13 which has been drawn into housing 137 from being discharged back to cartridge 21.

Similarly, outlet check valve assembly 151 comprises an outlet retention seat 159, an outlet check valve spring 161 and an outlet check valve ball 163. Spring 161 is disposed to resiliently urge ball 163 against retention seat 159. Ball 163 is sized and shaped relative to retention seat 159 so as to create a seal over retention seat 159 which is overcome only through activation of piston 139. Specifically, the pressure created inside housing 137 as piston 139 retracts from actuation overcomes the force of spring 161, thereby allowing ball 163 to float off seat 159 to permit the passage of base substance 13 out of interior cavity 147. As such, outlet check valve assembly 151 creates a one-way seal which allows for base substance 13 to flow out of housing 137 but prevents base substance 13 which has dispensed out from housing 137 from being discharged back into housing 137.

Piston 139 is a generally T-shaped member which is integrally coupled to a trigger 165 which includes a trigger actuation surface 167. A compression spring 169 is disposed within interior cavity 147 in abutment against piston 139. As a result, the application of an actuation force upon actuation surface 167 causes piston 139 to inwardly displace, thereby compressing spring 169. Upon release of the actuation force, spring 169 resiliently urges piston 139 back out to its original position. As such, upon release of trigger 165, the vacuum created by the force of spring 169 against piston 139 draws a fixed amount of base solution 13 from cartridge 21 and the pressure created when the actuation force displaces piston 139 serves to dispense said fixed amount of base solution 13 out through outlet port 145.

Inlet tube 141 is constructed of a conventional plastic tubing and is sized and shaped to be fittingly coupled, at one end, to suction dip tube 99. Inlet tube 141 is also sized and shaped to be fittingly coupled, at the other end, to inlet retention seat 153. As such, inlet tube 141 provides fluid communication from dip tube 99 to interior cavity 147.

Outlet tube 143 is similarly constructed of a conventional plastic tubing and is sized and shaped to be fittingly coupled, at one end, to outlet retention seat 159. Outlet tube 143 is also sized and shaped to be fittingly coupled, at the other end, to outlet port 145. As such, outlet tube 143 provides fluid communication from interior cavity 147 to outlet port 145.

Referring now to FIG. 10, device 11 further comprises a second pump mechanism 171 disposed within interior chamber 77 of dispenser head 17 which is adapted to dispense a user-selectable amount of booster substance 15 during use, as will be described further in detail below.

Second pump mechanism 171 comprises a piston housing 173, a piston 175 slidably disposed within piston housing 173, an inlet tube 177 which provides fluid communication between suction dip tube 103 and piston housing 173, an outlet tube 179 in fluid communication with piston housing 173, a return tube 181 which provides fluid communication between outlet tube 179 and return dip tube 107 and a discharge tube 183 which provides fluid communication between outlet tube 179 and an outlet port 185 which is formed in front end 79 of head 17.

Figure 11:
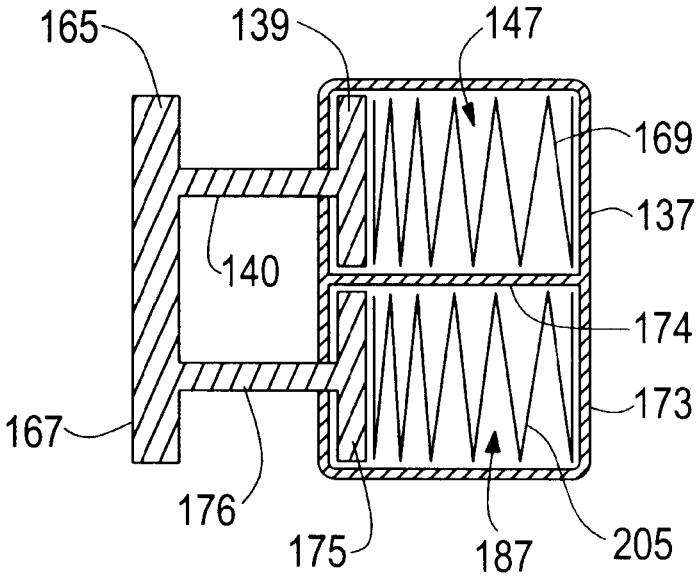
FIG. 11 is a top section view of the trigger, piston pump housings and pump springs shown in FIG. 10, taken along lines 11—11, the piston pump housings being shown without the check valve assemblies.
Figure 12:
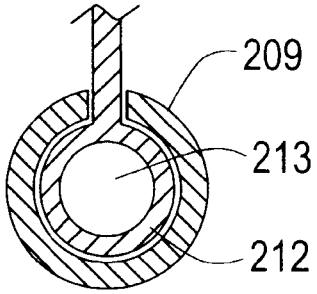
FIG. 12 is a fragmentary, rear section view of the selector dial and selector dial housing shown in FIG. 10, taken along lines 12—12.

Piston housing 173 is preferably, but not limited to, a generally rectangular enclosure which is shaped to include an interior cavity 187. Preferably, piston housings 139 and 173 are integrally formed together, such as through molding, so as to share a common wall 174, as shown in FIG. 11. As can be appreciated, the volume of interior cavity 187 determines the amount of booster substance 15 which is drawn from cartridge 23 during each stroke of piston 175.

Piston housing 173 further comprises an inlet check valve assembly 189 in fluid communication with interior cavity 187 and an outlet check valve assembly 191 in fluid communication with interior cavity 187.

Inlet check valve assembly 189 comprises an inlet retention seat 193, an inlet check valve spring 195 and an inlet check valve ball 197. Spring 195 is disposed to resiliently urge ball 197 against retention seat 193. Ball 197 is sized and shaped relative to retention seat 193 so as to create a seal over retention seat 193 which is overcome only through activation of piston 175. Specifically, the vacuum created inside housing 173 as piston 175 retracts from actuation overcomes the force of spring 195, thereby allowing ball 197 to float off seat 193 to permit the passage of booster substance 15 into interior cavity 187. As such, inlet check valve assembly 189 creates a one-way seal which allows for booster substance 15 to be drawn into housing 173 but prevents booster substance 15 which has been drawn into housing 173 from being discharged back to cartridge 23.

Similarly, outlet check valve assembly 191 comprises an outlet retention seat 199, an outlet check valve spring 201 and an outlet check valve ball 203. Spring 201 is disposed to resiliently urge ball 203 against retention seat 199. Ball 203 is sized and shaped relative to retention seat 199 so as to create a seal over retention seat 199 which is overcome only through activation of piston 175. Specifically, the pressure created inside housing 173 as piston 175 overcomes the force of spring 201 allows ball 203 to float off seat 199 to permit the passage of booster substance 15 out of interior cavity 187. As such, outlet check valve assembly 191 creates a one-way seal which allows for booster substance 15 to flow out of housing 173 but prevents booster substance 15 which has dispensed out from housing 173 from being discharged back into housing 173.

Piston 175 is a generally T-shaped member which is integrally coupled to trigger 165. Because pistons 139 and 175 are both integrally coupled to common trigger 165, the actuation of common trigger 165 simultaneously displaces both piston 139 and piston 175. A compression spring 205 is disposed within interior cavity 187 in abutment against piston 175. As a result, the application of an actuation force upon actuation surface 167 causes piston 175 to inwardly displace, thereby compressing spring 205. Upon release of the actuation force, spring 205 resiliently urges piston 175 back out to its original position. As such, upon actuation of trigger 165, the vacuum created by the force of spring 205 against piston 175 draws a fixed amount of booster solution 15 from cartridge 23 and the pressure created when piston 175 retracts back to its original position serves to dispense said fixed amount of booster solution 15 out through outlet tube 179.

It should be noted that device 11 is not limited to having springs 169 and 205 be positioned within interior cavities 147 and 187, respectively. Rather, it is to be understood that springs 169 and 205 could be alternatively positioned outside of interior cavities 147 and 187, respectively, without departing from the spirit of the present invention. For example, spring 169 could be positioned outside of housing 137 and coiled around shaft 140 of piston 139 without departing from the spirit of the present invention. Similarly, spring 205 could be positioned outside of housing 173 and coiled around shaft 176 of piston 175 without departing from the spirit of the present invention.

Inlet tube 177 is constructed of a conventional plastic tubing and is sized and shaped to be fittingly coupled, at one end, to suction dip tube 103. Inlet tube 177 is also sized and shaped to be fittingly coupled, at its other end, to inlet retention seat 193. As such, inlet tube 177 provides fluid communication from dip tube 103 to interior cavity 187.

Outlet tube 179 is also constructed of a conventional plastic tubing and is sized and shaped to be fittingly coupled, at one end, to outlet retention seat 199. Outlet tube 179 is also sized and shaped to be fittingly coupled, at its other end, to both return tube 181 and discharge tube 183. As such, outlet tube 179 provides fluid communication from interior cavity 187 to return tube 181 and discharge tube 183.

Return tube 181 is also constructed of a conventional plastic tubing and is sized and shaped to be fittingly coupled, at one end, to outlet tube 179. Return tube 181 is also sized and shaped to be fittingly coupled, at its other end, to return dip tube 107. As such, return tube 181 provides fluid communication from outlet tube 179 to cartridge 23.

Discharge tube 183 is also constructed of a conventional plastic tubing and is sized and shaped to be fittingly coupled, at one end, to outlet tube 179. Discharge tube 183 is also sized and shaped to being fittingly coupled, at its other end, to outlet port 185. As such, discharge tube 183 provides fluid communication from outlet tube 179 to outlet port 185.

Second pump mechanism 171 further includes a user-selectable valve assembly 207 for regulating the amount of booster substance 15 which discharged from device 11. Specifically, user-selectable valve assembly 207 is coupled to second pump mechanism 171 so as to regulate the amount of booster substance 15 which travels through discharge tube 183 and is dispensed out outlet port 185. Valve assembly 207 comprises a valve housing, or distributor, 209 and a valve 211 rotatably disposed within valve housing 209. Valve housing 209 is ducted to enable portions of outlet tube 179, return tube 181 and discharge tube 183 to pass therethrough. Valve 211 is preferably a ball valve which is fittingly disposed within housing 209. Valve 211 comprises a ball portion 212 which is shaped to include an elongated cylindrical channel 213 therein and a metering dial 215 coupled to ball portion 212. Metering dial 215 is disposed to project out top surface 73 dispenser head 17, and is capable of rotation, top surface 73 being provided with an arrow 74, or other similar marking, to demarcate the relative position of dial 215.

Valve 211 can be rotated between a fully open position and a fully closed position. When valve 211 is in its fully closed position, ball portion 212 is orientated such that the longitudinal axis of elongated channel 213 extends perpendicularly in relation to the longitudinal axis of discharge tube 183. As such, ball portion 212 prevents booster substance 15 from being able to pass through channel 213 and, accordingly, out discharge tube 183. As a result, the entire amount of booster substance 15 which is extracted from cartridge 23 and passed through outlet tube 179 is routed through return tube 181 and, accordingly, back into cartridge 23.

When valve 211 is in its fully open position, ball portion 212 is orientated such that the longitudinal axis of elongated channel 213 extends in parallel in relation to the longitudinal axis of discharge tube 183. As such, ball portion 212 allows booster substance 15 to pass through channel 213 and, accordingly, out discharge tube 183. As a result, a percentage of booster substance 15 will be discharged through discharge tube 183 and out port 185 and the remainder of booster substance 15 will be discharged through return tube 181 and back into cartridge 23.

As can be appreciated, rotating dial 215 so as to position valve 211 between its fully closed position and its fully open position (approximately 90 degrees) serves to regulate the amount of booster substance 15 which is dispensed out port 185. Furthermore, because a fixed amount of base substance 13 is dispensed out port 145 upon the inward displacement of trigger 165, valve assembly 207 enables the user to dispense base and booster substances 13 and 15 in a user selectable ratio, which is a principal object of the present invention.

It should be noted that outlet ports 145 and 185 are preferably positioned within a concave surface 217 formed in front end 79 of head 17. A plastic cap 218 is sized and shaped to be removably disposed within concave surface 217 to cover outlet ports 145 and 183 when device 11 is not being used.

It should be noted that the positioning of outlet ports 145 and 183 within concave surface 217 directs the dispensed amounts of base substance 13 and booster substance 15 towards one another a short distance away from surface 217. As base substance 13 and booster substance 15 come together, substances 13 and 15 may or may not mix depending upon the viscosity of the substances and the velocity with which they are discharged from device 11. If substances 13 and 15 do not mix, it is to be understood that the user is expected to mix the substances together, such as by rubbing his/her hands, to create a more homogenous solution. The fact that substances 13 and 15 are mixed only after exiting device 11 serves to eliminate system drag in device 11 and ensures that subsequent dosages match the setting on metering dial 215 without the need to purge the system, which is highly desirable.

As can be appreciated, device 11 has numerous potential applications. As an example of one potential application, device 11 could be used to dispense suntan lotion. Specifically, conventional suntan lotion is typically comprised of a mixture of a base substance commonly in the form of a moisturizing and/or scented lotion and a booster substance commonly in the form of a sunblock solution, such as conventional SPF liquid. As can be appreciated, adjusting the ratio of the booster substance relative to the base substance produces suntan lotions of varying sunblock protection (e.g., SPF 5 through SPF 30). As another example, device 11 could be used to dispense other substances which are formed from a mixture of a base substance and a booster substance, such as cosmetic, food or drink products.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A device for dispensing a base substance and a booster substance in a user selectable ratio, said device comprising:

a. a dispenser head comprising a first cartridge receiving recess, a second cartridge receiving recess, a first suction dip tube having a tip which is positioned within the first cartridge receiving recess, a second suction dip tube having a tip which is positioned within the second cartridge receiving recess and a return dip tube having a tip which is positioned within the second cartridge receiving recess;

b. a first cartridge coupled to said dispenser head, the first cartridge receiving recess in said dispenser head being sized and shaped to receive said first cartridge, said first cartridge containing the base substance;

c. a second cartridge coupled to said dispenser head, the second cartridge receiving recess in said dispenser head being sized and shaped to receive said second cartridge, said second cartridge containing the booster substance;

d. a first pump assembly disposed within said dispenser head, said first pump assembly comprising an inlet tube in communication with the first suction dip tube for drawing a fixed amount of the base substance from said first cartridge and an discharge tube for dispensing the fixed amount of the base substance out said dispenser head; and e. a second pump assembly disposed within said dispenser head, said second pump assembly comprising an inlet tube in communication with the second suction dip tube for drawing a fixed amount of the booster substance from said second cartridge, a discharge tube for dispensing a user selectable percentage of the fixed amount of the booster substance out said dispenser head and a return tube in communication with the return dip tube for rerouting the remaining percentage of the fixed amount of the booster substance back into said second cartridge.

2. The device of claim 1 wherein each of said first and second cartridges are removably mounted onto said dispenser head.

3. The device of claim 2 wherein each of the first and second cartridges comprise a collapsible liner which is mounted onto a supporting frame.

4. The device of claim 3 wherein the liner of each of said first and second cartridges includes an open top end which is enclosed by a seal, the tip of the first suction dip tube being sharpened to pierce through the seal of said first cartridge when said first cartridge is mounted onto said dispenser head, the tips of the second suction dip tube and return dip tube being sharpened to pierce through the seal of said second cartridge when said second cartridge is mounted onto said dispenser head.

5. The device of claim 4 wherein the supporting frame of each of said first and second cartridges comprises a head.

6. The device of claim 5 wherein the head of said first cartridge is shaped to include an outwardly projecting flange which is shaped to matingly fit within a flange receiving recess in the first cartridge receiving recess and wherein the head of said second cartridge is shaped to include an outwardly projecting flange which is shaped to matingly fit within a flange receiving recess in the second cartridge receiving recess.

7. The device of claim 6 wherein the shape of the flange of said first cartridge is different from the shape of the flange of said second cartridge.

8. The device of claim 7 wherein the head of each of said first and second cartridges is shaped to include a neck which is shaped to include an outwardly projecting snap-in ring which sized and shaped to fit securely within an associated retention ring recess formed in said dispenser head.

9. The device of claim 8 wherein said dispenser head comprises a top surface, bottom surface and a continuous sidewall which together define an interior chamber.

10. The device of claim 9 wherein the bottom surface of said dispenser head is shaped to include a first cartridge receiving recess which is sized and shaped to receive the head of said first cartridge and a second cartridge receiving recess which is sized and shaped to receive the head of said second cartridge, the first cartridge receiving recess having a different shape than the second cartridge receiving recess.

11. The device of claim 10 further comprising a dispenser body mounted onto said dispenser head over said first and second cartridges, said dispenser body comprising a front which is shaped to include a plurality of finger-shaped indentations.

12. The device of claim 11 wherein the supporting frame of each of said first and second cartridges comprises a foot and at least one side member which connects said head to said foot, said device further comprising a dispenser bottom cap mounted onto said dispenser body over said first and second cartridges, said dispenser bottom cap comprising a first pad for providing support against the foot of said first cartridge and a second pad for providing support against the foot of said second cartridge.

13. The device of claim 12 further comprising a valve assembly for limiting the percentage of the fixed amount of booster substance which is dispensed out the dispenser head through the discharge tube of said second pump assembly.

14. The device of claim 13 wherein said valve assembly comprises a valve housing and a valve rotatably disposed within said valve housing.

15. The device of claim 14 wherein said valve comprises a ball portion having an elongated channel extending therethrough and a metering dial coupled to said ball portion, said metering dial being disposed to project out the top surface of said dispenser head.

16. The device of claim 13 wherein each of said first and second pump assemblies comprise a piston housing, a piston slidably disposed within the piston housing and a spring disposed within the piston housing in abutment against the piston.

17. The device of claim 16 wherein the discharge tube of each of said first and second pump assemblies is in fluid communication with an associated outlet port formed in said dispenser head.

18. The device of claim 17 wherein the outlet ports are spaced slightly apart and are formed into a concave surface in said dispenser head.

19. The device of claim 18 wherein the pistons of said first and second pump assemblies are coupled to a common trigger.

20. The device of claim 19 wherein the piston housings of said first and second pump assemblies are formed together to share a common wall.

21. A device for dispensing a base substance and a booster substance in a user selectable ratio, said device comprising:

a. a dispenser head;

b. a first cartridge removably mounted onto said dispenser head, said first cartridge comprising a liner which is mounted onto a supporting frame, the liner of said first cartridge containing the base substance, the liner of said first cartridge including an open top end which is enclosed by a foil seal, the supporting frame of said first cartridge comprising a head, a foot and at least one side support member which connects the head to the foot, the head of said first cartridge being shaped to include an outwardly projecting flange which is shaped to matingly fit within a flange receiving recess formed in said dispenser head;

c. a second cartridge removably mounted onto said dispenser head, said second cartridge comprising a liner which is mounted onto a supporting frame, the liner of said second cartridge containing the booster substance, the liner of said second cartridge including an open top end which is enclosed by a foil seal, the supporting frame of said second cartridge comprising a head, a foot and at least one side support member which connects the head to the foot, the head of said second cartridge being shaped to include an outwardly projecting flange which is shaped to matingly fit within a flange receiving recess formed in said dispenser head;

d. a first pump assembly disposed within said dispenser head, said first pump assembly comprising an inlet tube for drawing a fixed amount of the base substance from said first cartridge and an discharge tube for dispensing the fixed amount of the base substance out said dispenser head; and e. a second pump assembly disposed within said dispenser head, said second pump assembly comprising an inlet tube for drawing a fixed amount of the booster substance from said second cartridge, a discharge tube for dispensing a user selectable percentage of the fixed amount of the booster substance out said dispenser head and a return tube for rerouting the remaining percentage of the fixed amount of the booster substance back into said second cartridge.

22. The device of claim 21 wherein the shape of the flange of said first cartridge is different from the shape of the flange of said second cartridge.

23. The device of claim 22 wherein the head of each of said first and second cartridges is shaped to include a neck which is shaped to include an outwardly projecting snap-in ring which sized and shaped to fit securely within an associated retention ring recess formed in said dispenser head.

24. The device of claim 23 wherein said dispenser head comprises a top surface, bottom surface and a continuous sidewall which together define an interior chamber.

25. The device of claim 24 wherein the bottom surface of said dispenser head is shaped to include a first cartridge receiving recess which is sized and shaped to receive the head of said first cartridge and a second cartridge receiving recess which is sized and shaped to receive the head of said second cartridge, the first cartridge receiving recess having a different shape than the second cartridge receiving recess.

26. The device of claim 25 further comprising a dispenser body mounted onto said dispenser head over said first and second cartridges, said dispenser body comprising a front which is shaped to include a plurality of finger-shaped indentations.

27. The device of claim 26 further comprising a dispenser bottom cap mounted onto said dispenser body over said first and second cartridges, said dispenser bottom cap comprising a first pad for providing support against the foot of said first cartridge and a second pad for providing support against the foot of said second cartridge.

28. The device of claim 27 further comprising a valve assembly for limiting the percentage of the fixed amount of booster substance which is dispensed out the dispenser head through the discharge tube of said second pump assembly.

29. The device of claim 28 wherein said valve assembly comprises a valve housing and a valve rotatably disposed within said valve housing.

30. The device of claim 29 wherein said valve comprises a ball portion having an elongated channel extending therethrough and a metering dial coupled to said ball portion, said metering dial being disposed to project out the top surface of said dispenser head.

31. The device of claim 28 wherein each of said first and second pump assemblies comprise a piston housing, a piston slidably disposed within the piston housing and a spring disposed within the piston housing in abutment against the piston.

32. The device of claim 31 wherein the discharge tube of each of said first and second pump assemblies is in fluid communication with an associated outlet port formed in said dispenser head.

33. The device of claim 32 wherein the outlet ports are spaced slightly apart and are formed into a concave surface in said dispenser head.

34. The device of claim 33 wherein the pistons of said first and second pump assemblies are coupled to a common trigger.

35. The device of claim 34 wherein the piston housings of said first and second pump assemblies are formed together to share a common wall.

36. The device of claim 6 wherein the flange receiving recess in the first cartridge receiving recess is positioned beneath the tip of the first suction dip tube and the flange receiving recess in the second cartridge receiving recess is positioned beneath the tip of the second suction dip tube and the tip of the return dip tube.

* * * * *